United States Patent [19]

Abbestam et al.

[11] 4,387,635

[45] Jun. 14, 1983

[54] MACHINE TOOL

[75] Inventors: Kaj Abbestam, Bollebygd; Göran Palmers, Askim, both of Sweden

[73] Assignee: Institutet for Verkstadsteknisk Forskning, Gothenburg, Sweden

[21] Appl. No.: 260,729

[22] Filed: May 5, 1981

[30] Foreign Application Priority Data

May 6, 1980 [SE] Sweden ..... 8003365

[51] Int. Cl.[3] ..... B30B 1/18; B30B 15/04

[52] U.S. Cl. ..... 100/214; 72/449; 83/631; 100/270; 100/290

[58] Field of Search ..... 100/270, 271, 214, 290; 83/631; 72/429, 449

[56] References Cited

U.S. PATENT DOCUMENTS

| | | | |
|---|---|---|---|
| 327,297 | 9/1885 | McGovern | 100/214 X |
| 859,637 | 7/1907 | Adams | 100/290 X |
| 1,503,575 | 8/1924 | Williams | 100/290 X |
| 1,512,279 | 10/1924 | Diehl | 100/290 X |
| 1,819,704 | 8/1931 | Friz | 100/290 X |
| 2,148,704 | 2/1939 | Merritt | 100/270 |
| 2,357,508 | 9/1944 | Ernst | 100/270 |
| 2,896,529 | 7/1959 | Shiokawa | 100/290 |
| 3,079,856 | 3/1963 | Swartz | 100/290 X |
| 3,400,625 | 9/1968 | Wrona | 100/214 X |

FOREIGN PATENT DOCUMENTS

| | | | |
|---|---|---|---|
| 879087 | 6/1953 | Fed. Rep. of Germany | 100/290 |
| 1080506 | 4/1960 | Fed. Rep. of Germany . | |
| 1477662 | 6/1969 | Fed. Rep. of Germany . | |
| 2458796 | 6/1976 | Fed. Rep. of Germany . | |
| 1488606 | 6/1967 | France . | |

*Primary Examiner*—Billy J. Wilhite

*Attorney, Agent, or Firm*—Holman & Stern

[57] ABSTRACT

A machine tool comprising a portal stand having a number of, preferably four, screw pillars and a moveable yoke driven and guided along the screw pillars by means of nuts preferably roller nuts, in the yoke. Tools, machining devices or the like can be attached to the yoke. The nuts are driven simultaneously by a drive motor through a drive shaft extending therefrom. A very good parallel guiding of the yoke is achieved despite uneven loads. When the power demand is high, for example during heavy pressings, an auxiliary cylinder is provided, the piston rod of which is fixed to the yoke.

5 Claims, 5 Drawing Figures

MACHINE TOOL

FIELD OF THE INVENTION

The present invention relates to a machine tool for performing pressing and/or cutting tooling operations during motion, said machine comprising a portal stand comprising at least three pillars and at least one yoke moveable along the pillars for supporting tools and the like for said tooling operations.

DESCRIPTION OF THE PRIOR ART

There exists today a great need for a flexible production apparatus that can be used for a number of different machine tool operations. Thus it is desirable to have one and the same machining unit able to carry out a plastic forming operation for example pressing, deep drawing, etc., as well as drilling, thread cutting, cutting, punching, milling, turning etc.

The conventional mechanical equipment available within this field today comprises hydraulic and eccentric presses and machine tools for cutting tooling. However presses cannot perform a cutting tooling and cutting machines are not adapted to perform pressing operations. Thus the workpiece has to be moved several times to different machines and the repeated chucking work requires a lot more time than the work operation itself.

The production modules existing today for the above mentioned purposes are either enormously large machines, such as eccentric type presses, which have the required stiffness and the capability of withstanding eccentric loads, or machines, which cannot withstand any eccentric loads, because of too great a flexibility when fully loaded etc.

Such a machine is shown in e.g. the German "Offenlegungsschrift" No. 1.477.622. It comprises a portal stand consisting of two or more pillars which form a guide for as many tubes, which are displaceable along the pillars. Two yokes are fixed on the arms at a certain distance from each other. Between the yokes a machining device is supported, which may comprise a press, a rotary body, a heat treating device etc. Screws, which are turned by a motor mounted above the yoke, make the yokes and thereby the machining apparatus move along the pillars.

This device provides a very good guide for the machining apparatus, but the yoke height is very large. The device works only as a power supplier to the machining apparatus and not as a paralleling means. The screws are self-braking and cannot eliminate moment of force caused by possible uneven loads. These moments of force must instead be carried by the control pillars and can cause their deformation.

Another known construction is shown in the U.S. Pat. No. 2,896,529, disclosing a screw press working with two bolt attachments, whereby the one bolt attachment forms resistance during the lifting movement, so that the other bolt attachment is relieved and can be screwed a distance corresponding to the lift height. The bolts cannot work in loaded state. There is no parallel guide of the machining plate and the arrangement is therefore very sensitive to uneven loads.

SUMMARY OF THE INVENTION

The object of the invention is to provide a machine tool, which is so constructed that it can perform both a pressing and cutting tooling, and which provides:

(a) a very good parallel holding and guide of the machine tool along the pillars,
(b) non-sensitivity to uneven loads, retaining its good parallel holding,
(c) a very small flexibility even when heavily loaded,
(d) a very high repeating exactness,
(e) a very favourable relationship between machine weight and machine volume, and
(f) a large length of stroke despite a limited height.

It is a further object of the invention to provide a machine tool which is easy to mechanize and automate so that it can easily form a part of a manufacturing line.

The objects have according to the invention been solved by the fact that the pillars comprise screw spindles that are fixedly mounted in the axial direction in the stand and that non self-braking nuts in the form of roller- or ball nuts cooperating with the screw spindles are rotatably but axially undisplaceably mounted in or at the yoke, the nuts being arranged to carry axial tractive and compressive forces, said nuts and/or the screw spindles being arranged to be simultaneously and syncronously driven by at least one driving means, so that the yoke is loadable and displaceable along the pillars with a stepless, adjustable speed.

DESCRIPTION OF THE DRAWINGS

The invention will now be further described with reference to some embodiments shown on the attached drawings wherein.

DETAILED DESCRIPTION

Figure 1:
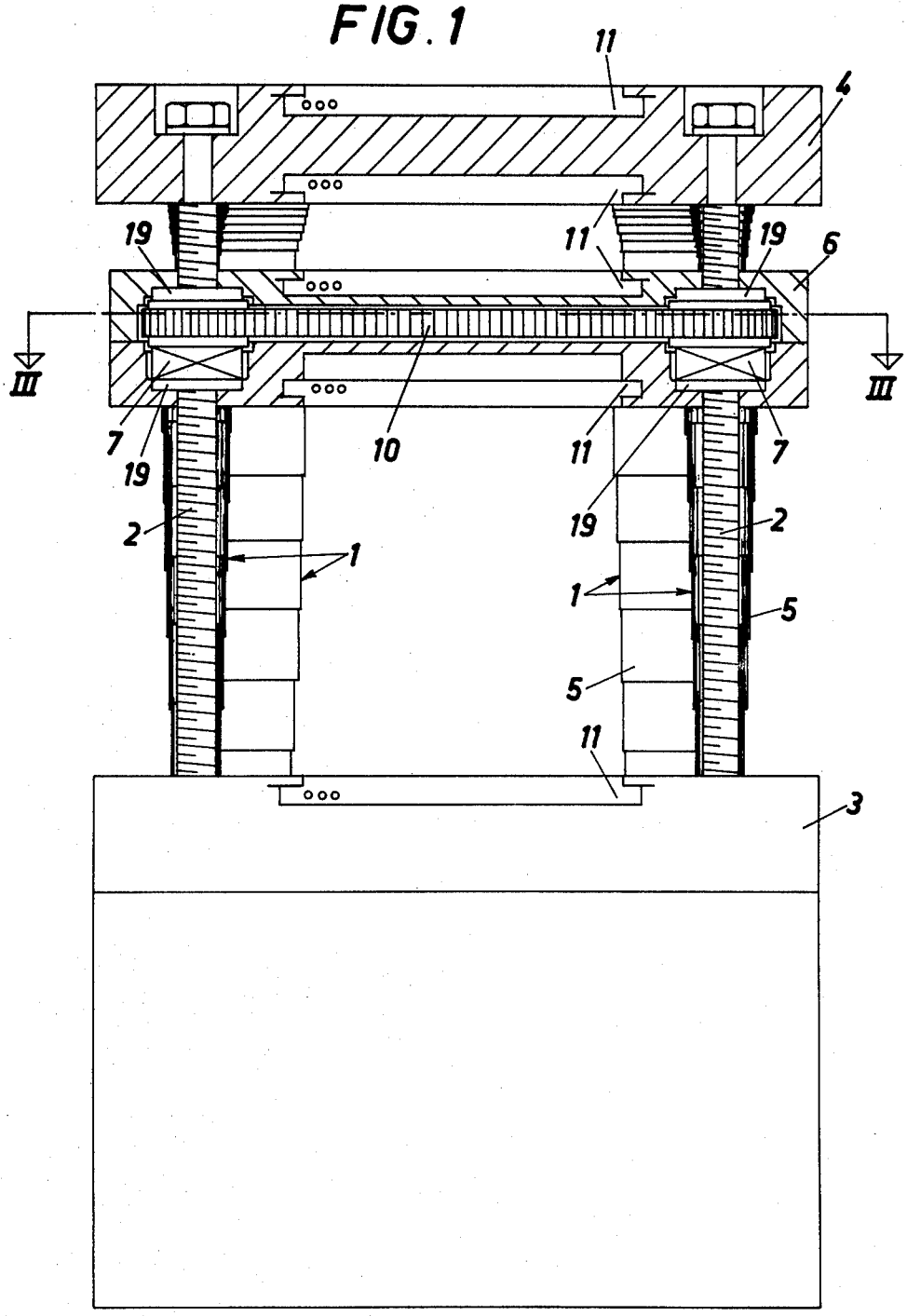
FIG. 1 is a front elevational view partly in section of an embodiment of the machine tool according to the invention.

The machine tool according to FIG. 1 consists of a portal stand comprising four pillars 1, which are made up of four screw spindles 2, that are fixed to the bottom plate 3 of the stand. The screws 2 are at the top joined together by and fixed to the upper plate 4 of the stand. The screws 2 are arranged inside telescoping seals 5.

Figure 2:
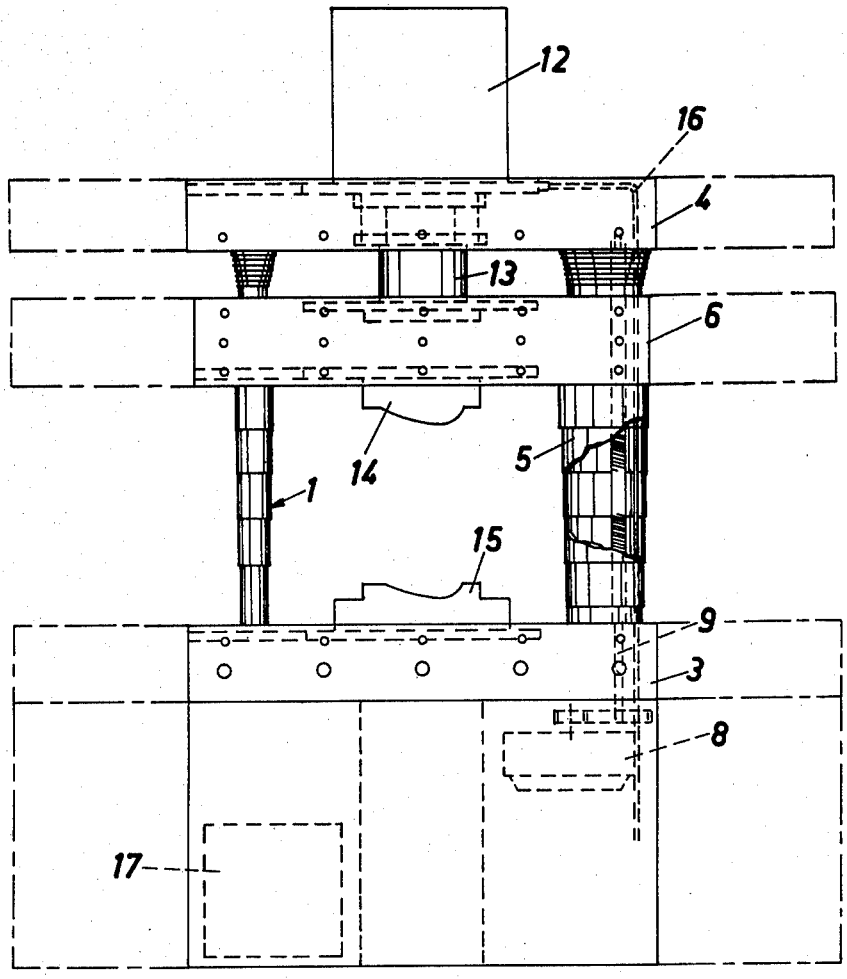
FIG. 2 is a side view of a modified machine tool in accordance with the invention.
Figure 3:
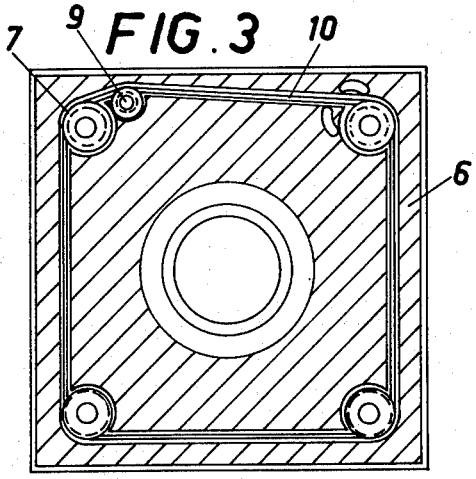
FIG. 3 is a cross-sectional view taken along line III—III in FIG. 1.

A moveable yoke 6 is further arranged within the portal stand, said yoke being guided along the screws 2 by means of four nuts 7, which are rotatably but axially undisplaceably mounted in the yoke 6. The nuts 7 are simultaneously driven by a driving motor 8 (FIG. 2) arranged in the space below the bottom plate 3 of the stand. A drive shaft 9 extends from the motor 8 and up to the yoke 6, where via a belt, chain 10 or similar power coupling device (FIG. 3) it is connected to the nuts 7 for simultaneously driving them. The drive shaft 9 is arranged inside the telescoping sealing 5 of one of the rear pillars 1. Hydraulic conduits, electrical wiring etc. are also housed inside the telescoping sealings of the rear pillars, which are larger than those of the front pillars. All four screws 2 are however of the same dimension. It is of course also possible to arrange the drive motor inside the top plate 4 or the yoke 6. Instead of driving the nuts 7 it is of course possible to drive all screw spindles 2 by alternatively rotatably mounting them and fixing nuts 7 in the yoke (not shown).

In the bottom and top plates 3 and 4 of the stand as well as in the yoke 6 guides 11 for quick attachment of tools, machining equipment or similar device are arranged, for example for thread cutting, deep drawing, cutting, punching, turning and grinding tools.

The nuts 7 are non-self-braking, namely ball- or roller nuts, preferably precision roller nuts, which can carry higher loads than ball nuts. In addition the nuts 7 at both end gables are provided with thrust bearings 19. In roller nuts a number of rollers are running in an endless path. The nut has a correspondingly larger thread diameter than the screw and the rollers are provided with peripheral grooves, which cooperate with the threads in the nut and the screw respectively. Thus a roller nut has a very large number of effective points of contact, whereby it can carry high loads.

The nuts 7 both guide and drive the yoke 6 and by simultaneous driving of all nuts a very good parallel guiding is maintained despite uneven loads. Possible moment forces are taken up as tensile and compressive forces respectively in the screws 2. The displacement of the yoke 6 along the screws 2 can continuously be controlled and measured.

During machining operations demanding a relatively small power supply, for example cutting and light pressing operations, the yoke 6 with its roller nuts 7 make a single linearly guided and controlled driving means.

When the power demand is higher, for example during heavy pressing, an auxiliary cylinder 12 is necessary for driving, whereby the yoke 6 is guided and controlled by means of the screws 2. This is shown in the embodiment according to FIG. 2. The cylinder 12, for example a hydraulic cylinder is fixed to the top plate 4 and its piston rod 13 is connected to the yoke 6. A machining member 14 for pressing against a pad 15 supported in the bottom plate 3 is attached to the yoke 6. Hydraulic conduits 16 to the cylinder 12 extend through the telescoping sealing 5 from a hydraulic assembly 17 arranged in the space below the bottom plate 3. In this space is also room for the control and other equipment.

Figure 4:
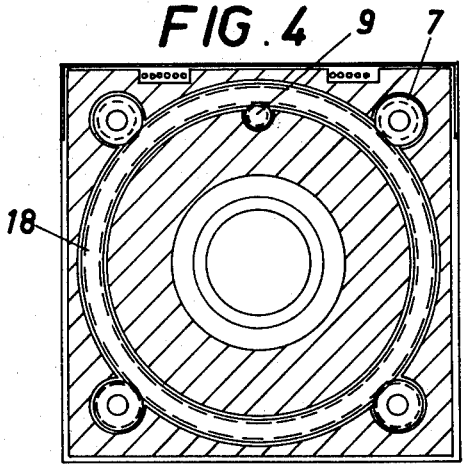
FIG. 4 is a corresponding cross-sectional view through another embodiment.

In the embodiment shown in FIG. 4 the drive shaft 9 is connected to the nuts 7 by a toothed wheel rim 18, which has a relatively large mass and thereby a high mass-moment of inertia. The toothed wheel rim 18 is rotated by the drive shaft 9 and the rotating movement is then used as a driving force during the machining operation. The drive shaft 9 is in this embodiment arranged substantially midway between two pillars and the drive motor is preferably placed in the yoke 6 itself.

Figure 5:
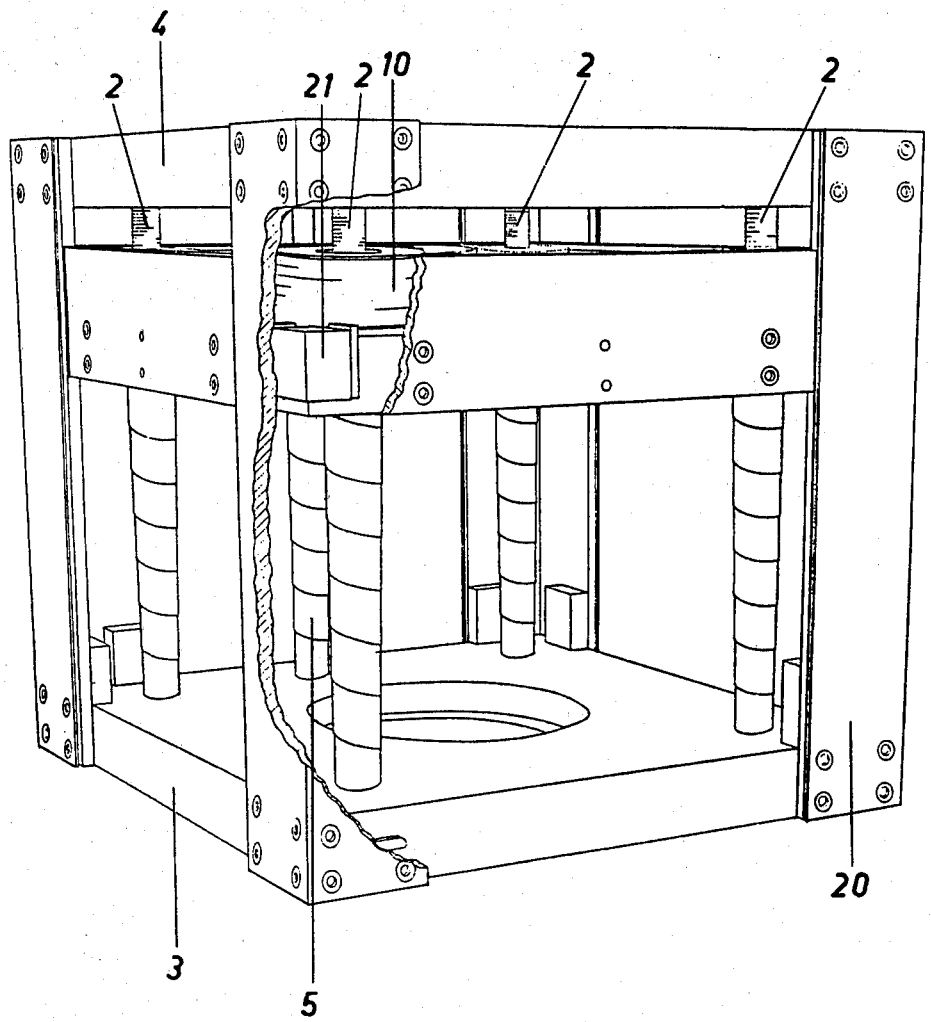
FIG. 5 is a perspective view of a further embodiment of the invention.

The machine tool according to FIG. 5 has a rectangular top-and bottom plate 4, 3, as well as the yoke 6, which facilitates series connection and automization. The top- and bottom plates 4 and 3 are at their corners interconnected by means of profiles 20 having an L-shaped cross-section and the yoke 6 adjacent these profiles is provided with sliding blocks 21. The profiles 20 act as guides, against which the sliding blocks 21 bear, but they also stiffen the construction i.e. for enabling the support of great radial forces.

Thus the machine tool according to the invention forms a basic unit, which can be complemented with different equipment for different machining operations. It is even possible to connect together a number of machine tools in production lines and for cooperative machining. A number of advantages with the machine tool according to the invention are:

- Less tied-up capital in special purpose machines;
- Fewer type restricted tools.
- Increased flexibility, when the same machine can be used for different machining functions;
- Quicker and cheaper establishment of production lines; and
- Increased possibilities for short series production in production lines.
- Better automation possibilities since uniform machines can be automated in the same way.

Another advantage with the machine tool according to the invention is that it has a cutting impact dampening effect, since the recoil action that results when the cutting is completed is converted to kinetic energy in the nuts 7.

The machining can even be done outside the portal stand by increasing the working surfaces of the bottom plate 3 and the yoke 6 with separate units extending outside the portal stand.

The invention is of course not limited to the shown embodiments, but can be modified within the scope of the claims. A simplified embodiment of the machine tool can for example have a stand without any top plate, i.e. the pillars are only fixed to a bottom plate. The number of pillars is in all of the shown embodiments four. It is however possible to have only three pillars or even five or more pillars.

We claim:

1. In a machine tool for pressing and cutting operations having a bottom plate and a top plate arranged in spaced relationship, a plurality of upright externally screw threaded spindles non-rotatably mounted at their ends in said bottom and top plate, and a yoke member for supporting tools to perform said operations moveably mounted on said spindles for reciprocating movement between said bottom and top plates, the improvement comprising non self-braking drive nuts rotatably mounted in said yoke member and operably coaxially engaging said screw-threaded spindles so that rotation of said nuts moves said nuts and said yoke along said spindles, drive means mounted on said machine tool operably connected to said nuts to simultaneously and synchronously rotate said nuts, elongated reinforcing guide members extending substantially along and adjacent to said spindles and attached at their ends to said bottom and top plates, and slide bearings mounted on said yoke and slidably engaging said guide members to guide and laterally support said yoke during its reciprocating movement.

2. A machine tool as claimed in claim 1 wherein said nuts comprise roller nuts coaxially and operably engaging said screw threaded spindles and mounted in said yoke for non-axial movement with respect thereto, said bottom and top plates and yoke are substantially rectangular, and said guide members have an L-shaped cross-sectional configuration and are attached at the corners of said bottom and top plates with the legs of the L extending along the sides of said plates, each slide bearing engaging both inside surfaces of said legs.

3. A machine tool as claimed in claim 2 wherein said drive nuts have external gear teeth and are rotatably mounted in said yoke by thrust bearings between the ends of said nuts and said yoke, and said drive means comprises a toothed wheel having gear teeth thereon, said wheel being rotatably mounted in said yoke about an axis centrally located with respect to the rotational axes of said drive nuts with the gear teeth thereof simultaneously engaging the gear teeth on said nuts, a drive motor, and a drive shaft operably engaging said wheel and connected to said motor to rotate said wheel by said motor.

4. A machine tool as claimed in claim 3 wherein said toothed wheel has a relatively large mass to provide a high moment of inertia, said bottom plate is supported on the top of a stand, said drive motor is mounted in said stand below said bottom plate, said screw spindles are enclosed within telescoping seals, and said drive shaft extends from said motor through said bottom plate and substantially parallel and adjacent to one of said screw spindles and within said respective seal.

5. A machine tool as claimed in claim 4 and further comprising an auxiliary hydraulic cylinder and piston means mounted on said top plate having a piston rod slidably extending through said top plate and connected to said yoke, and hydraulic pressure supply means connected to said cylinder to operate said piston, to augment the power supplied by said drive nuts to said yoke.

* * * * *